US010465333B1

(12) United States Patent
Baird

(10) Patent No.: US 10,465,333 B1
(45) Date of Patent: Nov. 5, 2019

(54) APPARATUS TO PREVENT WADDING OF SHEETS IN CLOTHES DRYER

(71) Applicant: John S. Baird, Birmingham, AL (US)

(72) Inventor: John S. Baird, Birmingham, AL (US)

( * ) Notice: Subject to any disclaimer, the term of this patent is extended or adjusted under 35 U.S.C. 154(b) by 211 days.

(21) Appl. No.: 15/666,111

(22) Filed: Aug. 1, 2017

(51) Int. Cl.
*D06F 59/08* (2006.01)

(52) U.S. Cl.
CPC ..... *D06F 59/08* (2013.01)

(58) Field of Classification Search
CPC ..... G09B 23/24; G09B 23/26; A63H 33/006; D06F 59/08; Y10T 24/23
See application file for complete search history.

(56) References Cited

U.S. PATENT DOCUMENTS 5,713,782 A * 2/1998 Jensen ..... A63H 5/00 446/419
5,785,529 A * 7/1998 Hearn ..... A63H 33/102 273/DIG. 2
6,887,841 B2 5/2005 Mattia et al.
D660,664 S * 5/2012 Hsu ..... D8/25
8,365,361 B1 2/2013 Ahern
2008/0110042 A1 5/2008 Ackermann et al.
2009/0071028 A1 3/2009 Gadke et al.
2010/0205787 A1* 8/2010 Remmert ..... D06F 95/008 24/302
2015/0026994 A1* 1/2015 Holder ..... D06F 58/20 34/236
2015/0104992 A1* 4/2015 Jung ..... A63H 33/102 446/91

FOREIGN PATENT DOCUMENTS

EP 2298984 A1 3/2011
JP 531297 2/1993

* cited by examiner

*Primary Examiner* — David J Laux
(74) *Attorney, Agent, or Firm* — Bush Intellectual Property Law; Kenneth M. Bush

(57) ABSTRACT

An apparatus to prevent a wet sheet or blanket from wadding when drying in a clothes-drying machine is provided having two opposing porous objects that are connected by a plurality of outwardly-bowed flexible tubes and a pair of securing straps extending between each object. The porous objects comprise reversibly engaging outside and inside portions that include a plurality of ventilation holes. The outside portions include a plurality of knobs for agitating and softening other articles of clothing during a drying cycle.

16 Claims, 9 Drawing Sheets

APPARATUS TO PREVENT WADDING OF SHEETS IN CLOTHES DRYER

FIELD OF THE INVENTION

The present invention relates to an apparatus for use when drying wet textile items such as blankets and sheets in a clothes dryer to prevent wadding.

BACKGROUND OF THE INVENTION

Drying blankets or sheets in a clothes dryer can be difficult and time-consuming because when wet these articles tend to twist into a tight wad or ball during the drying cycle. When this happens, the dryer is incapable of efficiently drying the center of the wadded blanket or sheet, which typically requires the blanket or sheet to be taken out of the dryer partway through the drying cycle, unraveled, and placed back in to complete the drying cycle. This wastes time and energy.

U.S. Patent Application Publication No. 2010/0205787 discloses an apparatus designed to prevent sheets from entangling with other items of clothing when drying in a clothes dryer. The apparatus includes a central hub and four radiating arms having ends that attach to each corner of a sheet. In use, the apparatus draws the corners of the sheet together to prevent entanglement with other laundry items.

U.S. Pat. No. 8,365,361 discloses a laundry retainer apparatus for drying bed sheets to prevent entanglement with other clothing during drying having a base plate and four clothes clips mounted thereto. The clips are secured to the corners of a sheet such that the corners are drawn together thereby preventing entanglement with other items.

U.S. Patent Application Publication No. 2015/0026994 discloses an apparatus for preventing entanglement of sheets in a dryer. The apparatus includes a central hub and six radiating tubular prongs spaced 90° from each other. In use, the apparatus is placed in a dryer with a wet sheet without attaching the apparatus to the sheet.

A need remains for an improved apparatus and method for drying sheets and blankets in a drying machine to improve drying efficiency and reduce user effort.

SUMMARY OF THE INVENTION

This summary is provided merely to introduce certain concepts and not to identify any key or essential features of the claimed subject matter. The present invention provides an apparatus and method to prevent wet blankets or sheets from wadding into a ball or cylinder when placed in a clothes dryer thereby improving drying efficiency. A blanket or sheet is secured around the apparatus before it is placed into the dryer to create an open space in the center of the blanket or sheet to allow free air flow. With the apparatus fixed in this fashion, the center of the blanket or sheet will dry faster and will not roll into a tight ball or cylinder. This improves drying efficiency and saves time by avoiding the need to unfold a wadded blanket or sheet during the drying cycle.

In one aspect, the inventive apparatus includes two opposing porous objects held in spaced relation to each other by a plurality of flexible tubing. A wet blanket or sheet is placed over the apparatus and secured thereto prior to being placed into a clothes-drying machine.

In another aspect, the present invention relates to a method for drying one or more wet sheets or blankets in a drying machine by attaching an apparatus of the present invention prior to starting a drying cycle.

DETAILED DESCRIPTION OF THE INVENTION

While the following description details preferred embodiments of the invention, and other aspects thereof, it is to be understood that the invention is not limited to the details of construction and arrangement of the parts illustrated in the accompanying drawings and description, since the invention is capable of other embodiments, and of being practiced in various ways. General descriptive terms pertaining to size and/or distance such as "small", "medium" and "large", or "close" and "far" or the like are intended to be relative terms.

As used herein, the term "wadding" generally refers to the tendency of a wet sheet or blanket to wad or clump to form a ball or cylinder when placed in a clothes-drying machine.

In one aspect, the invention provides an apparatus that has two hollow porous objects that are held in spaced relation to each other to provide an open structure around which a wet sheet or blanket can be secured prior to placement in a clothes dryer to prevent wadding. The hollow porous objects can be of any shape including but not limited to sphere, spheroid, ellipsoid, cube, or cuboid.

Figure 1A:
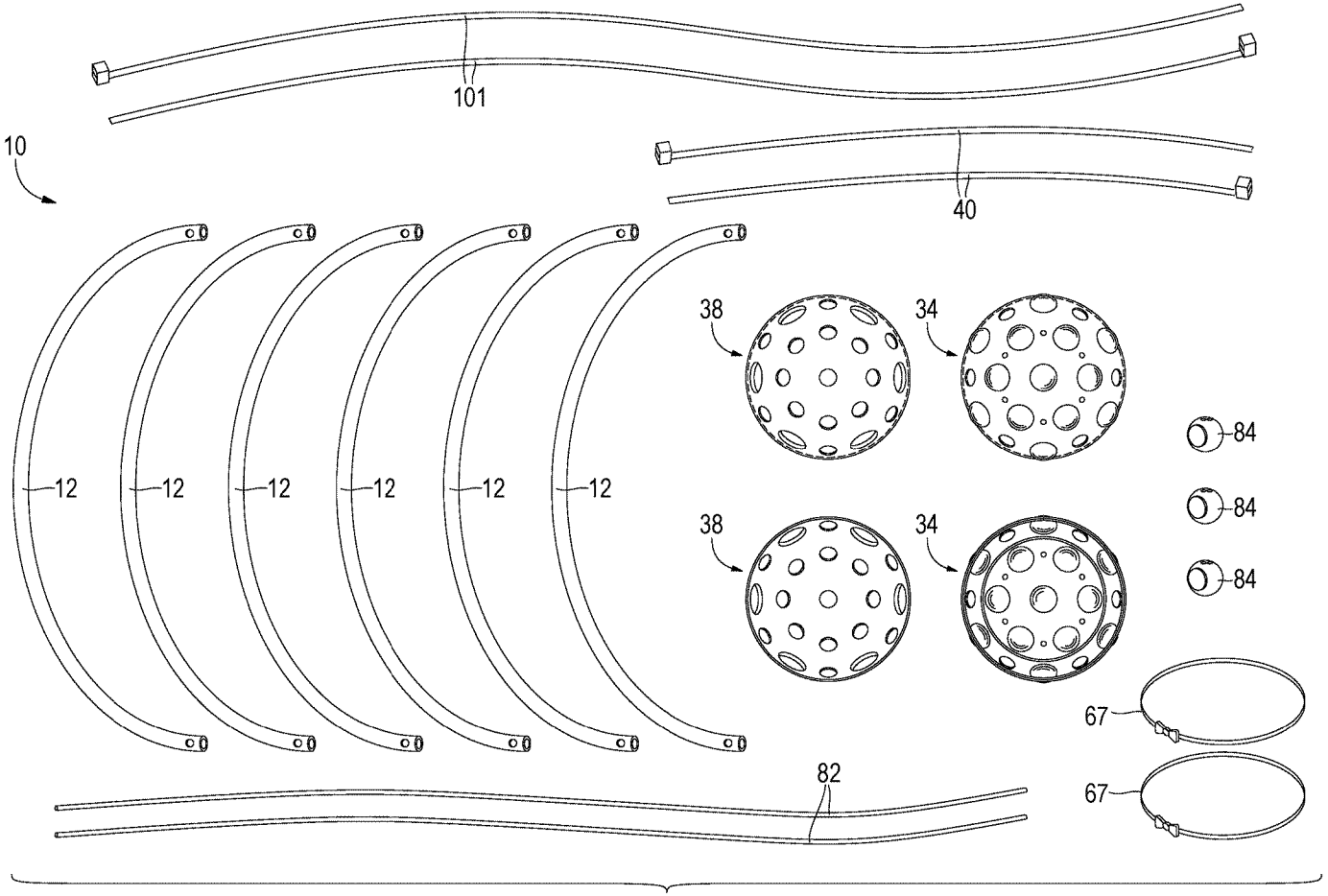
FIG. 1A provides an elevation view of a preferred embodiment of an apparatus of the invention showing the component parts in disassembled array.
Figure 1B:
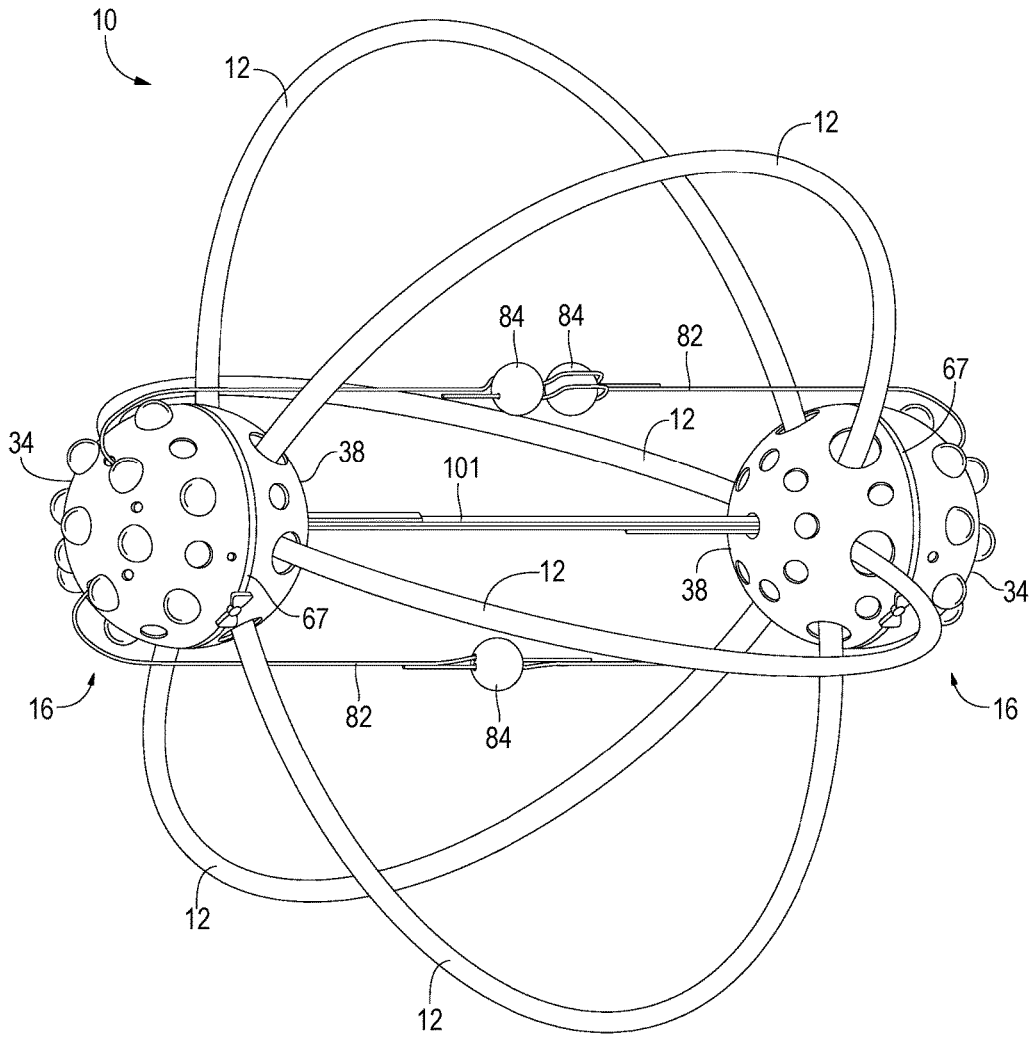
FIG. 1B shows a side perspective view of the embodiment of FIG. 1A when assembled.
Figure 1C:
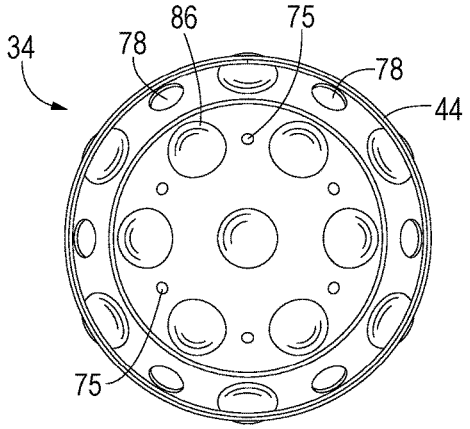
FIG. 1C shows an elevation perspective view of the interior of an outside hemisphere portion of an embodiment of an apparatus of the invention.
Figure 1D:
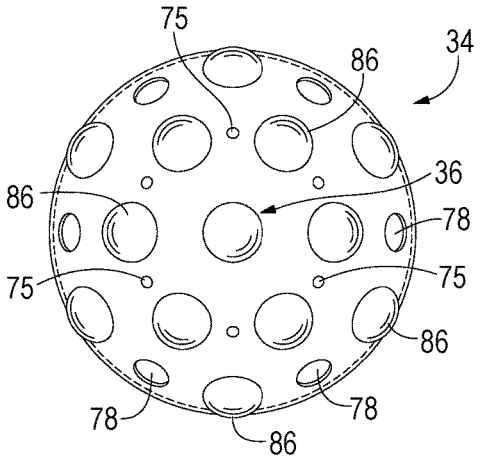
FIG. 1D shows an elevation perspective view of the exterior of an outside hemisphere portion of an embodiment of the invention.

Referring now to the Figures, a preferred embodiment of an apparatus of the invention is shown having spherically-shaped porous objects. FIG. 1A shows apparatus 10 in disassembled array. FIG. 1B shows the apparatus of FIG. 1A after being assembled. Apparatus 10 includes two hollow porous opposing spheres 16 and a plurality of flexible tubes or arms 12 that extend obliquely between each sphere to provide an outwardly-bowed configuration around which a wet sheet or blanket can be secured prior to placement in a clothes-drying machine. Sphere 16 preferably comprises two reversibly engaging hemisphere portions, outside hemisphere portion 34 and inside hemisphere portion 38. Sphere 16 can be fabricated by methods known to the skilled artisan, from any suitable material including plastic or rubber; preferably sphere 16 is fabricated from high-density polyethylene.

With reference now to FIGS. 1C-1F and 2A-2E certain aspects of the invention are described in more detail. Outside hemisphere 34 comprises a plurality of small holes 75 and medium holes 78 that perforate the walls thereof, and a circumferential flat side edge 44. Small holes 75 are included to accommodate a sheet securing cord (discussed below), and are preferably evenly distributed near the apex 36 and equidistant therefrom in diametric opposition to one another. Medium holes 78 are provided to facilitate ventilation and are preferably evenly distributed near flat side edge 44, equidistant from apex 36 and in diametric opposition to one another. In the preferred embodiment, there are from two to eight small holes 75, and from two to eight medium holes 78, most preferably six of each type. Outside hemisphere 34 preferably further includes a plurality of knobs 86 projecting outward from the surface thereof for agitating and softening other items of clothing that may be present during a drying cycle.

Figure 1E:
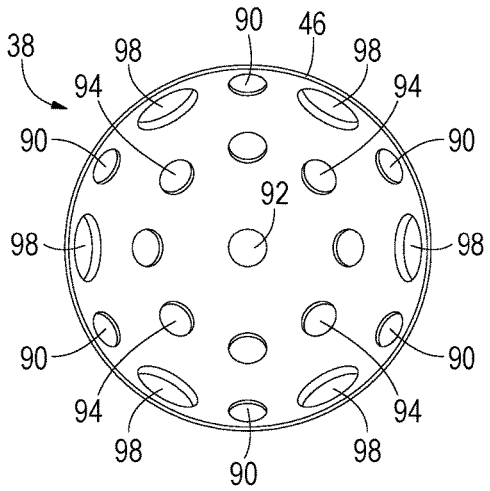
FIG. 1E shows an elevation view of the interior of an inside hemisphere portion of an embodiment of the invention.
Figure 1F:
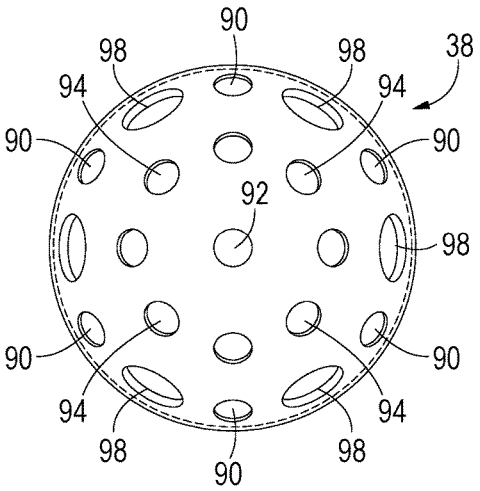
FIG. 1F shows an elevation view of the exterior of an inside hemisphere portion of an embodiment of the invention.

Inside hemisphere 38 includes a plurality of ventilation holes (FIGS. 1E-1F). A first group of ventilation holes 90 are arranged concentrically around the central axis of inside hemisphere 38, preferably evenly distributed and parallel to flat edge 46. A second group of ventilation holes 94 are preferably arranged concentrically between securing strap hole 92 and first group ventilation holes 90. Preferably there are from two to eight ventilation holes for each group, most preferably six for first group holes 90 and eight for second group holes 94, with the holes in each group being in diametric opposition to one another.

Figure 3A:
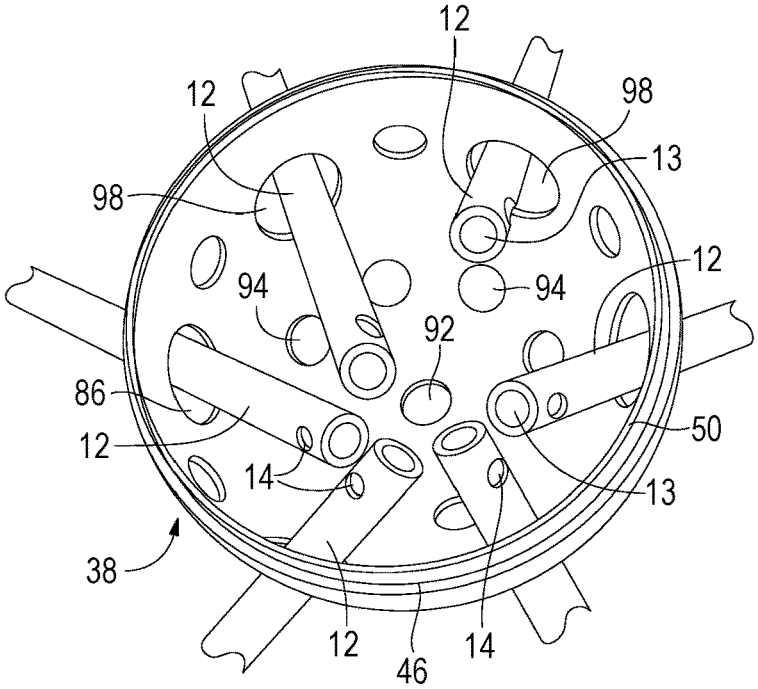
FIG. 3A provides a perspective view showing the hollow interior of an inside hemisphere section of a sphere of the invention with a plurality of flexible tube ends inserted therein.

Inside hemisphere 38 further includes a plurality of flexible tube holes 98 that preferably are interposed between ventilation holes 90. The number of flexible tube holes 98 corresponds with the number of flexible tubes 12 in apparatus 10 which can range from two to eight. Preferably, there are six flexible tube holes 98 each spaced about 60° apart from adjacent flexible tube holes to accommodate six flexible tubes. Flexible tube holes 98 have a diameter that is at least large enough to receive a flexible tube end when the latter is inserted into the inside hemisphere during assembly of the apparatus (FIG. 3A).

Figure 3B:
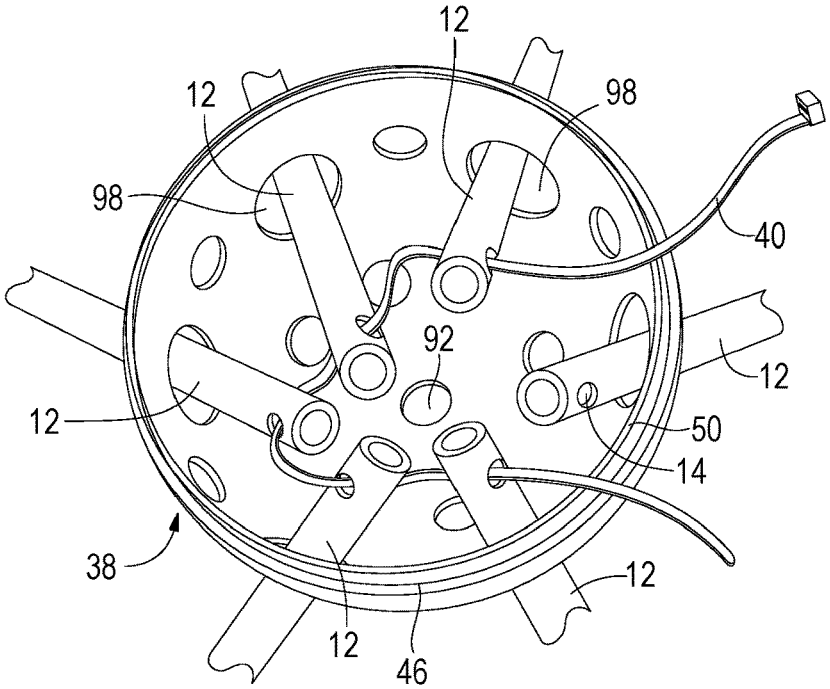
FIG. 3B shows the inside hemisphere section of FIG. 3A with a cord inserted through the flexible tube ends to cinch them together.
Figure 3C:
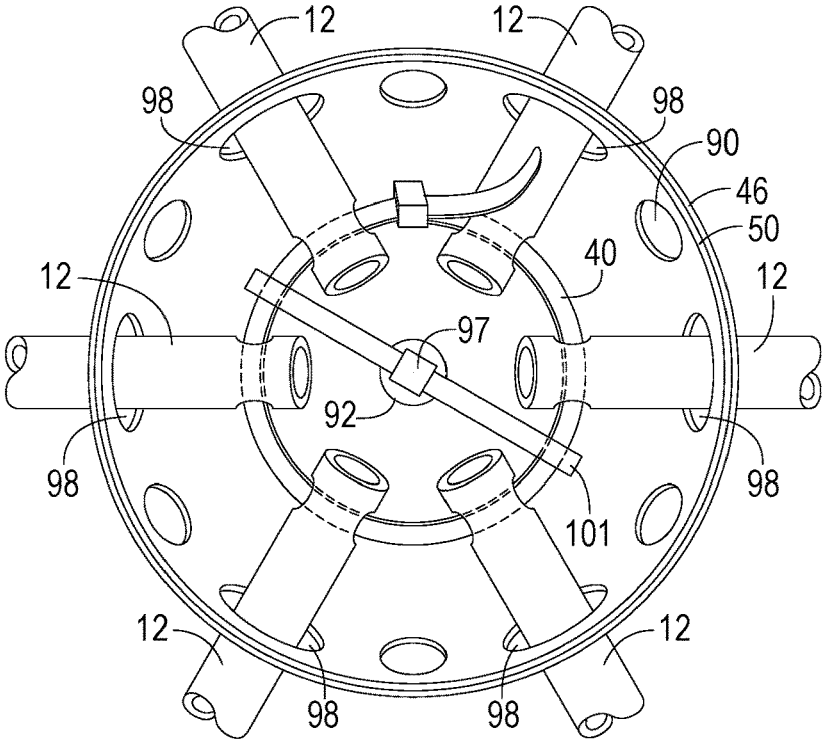
FIG. 3C provides an elevated view showing the interior of an inside hemisphere, flexible tube ends, tube end securing strap, and central securing straps of an embodiment of the invention.
Figure 3D:
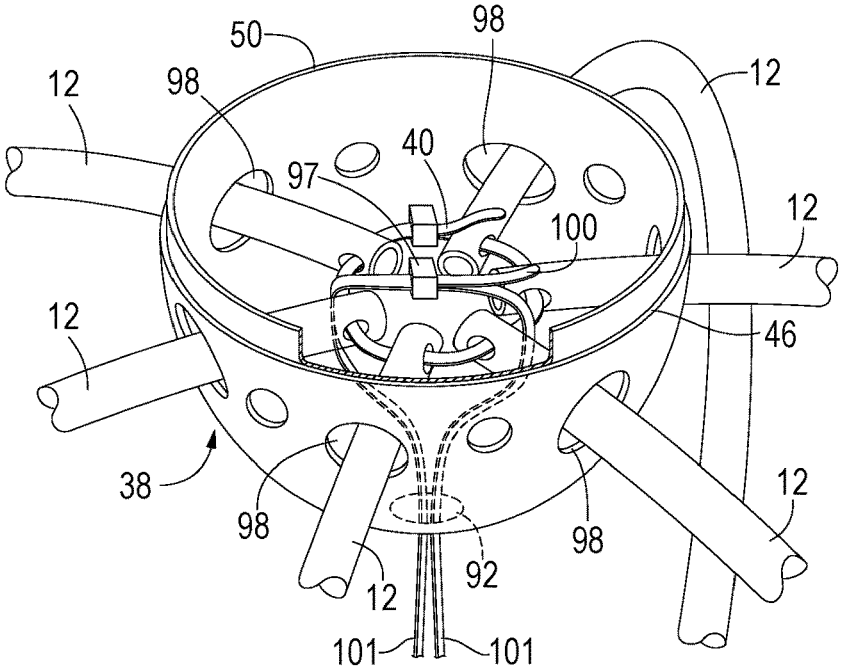
FIG. 3D provides a side perspective view of the inside hemisphere shown in FIG. 3C.

Inside hemisphere 38 also includes a securing strap hole 92 at the apex, through which passes two securing straps 101 that interpose between each of the two inside hemispheres to provide stability to the assembled apparatus (FIGS. 1B and 3C-3D). Securing straps 101 can be fabricated from any suitable material including plastic, fabric, or metal; preferably the securing straps are flexible nylon cable ties or zip ties consisting of a flexible tape and integrated gear rack, and a head having a ratchet and small open case 97, and a tail end 100 that can be pulled through the case at the head thereby preventing pull-back. Securing straps 101 are preferably from 18 inches to 24 inches in length; most preferably 20 inches. When installed, the two securing straps 101 are inserted through securing strap hole 92 of each inside hemisphere in opposite orientation such that the opposing ends of each strap are secured to each other over tube end securing strap 40. The securing straps 101 are joined by inserting the tail end of one strap into the head end of the other strap and thereafter tightening. The tightened securing straps 101 stabilize the configuration of the flexible tubes and the overall structure of apparatus 10.

Figure 2A:
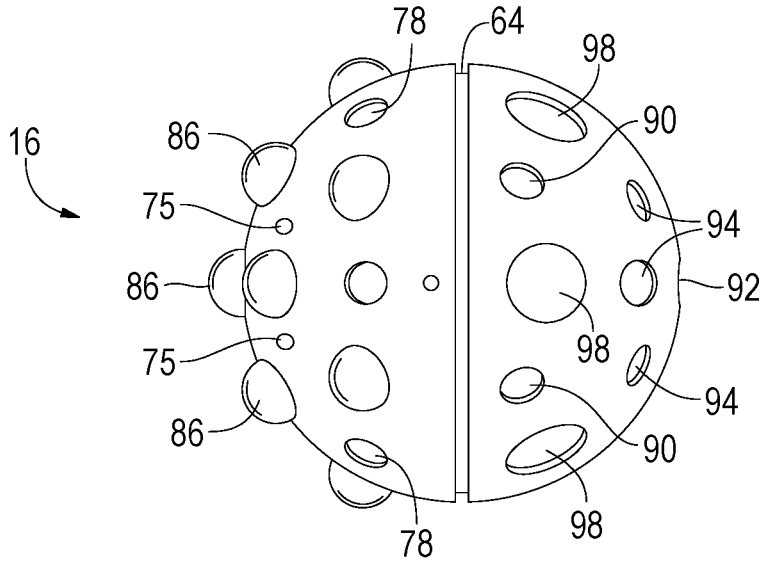
FIG. 2A shows a side view of a sphere-shaped embodiment of the present invention having engaged outside and inside hemisphere sections.
Figure 2B:
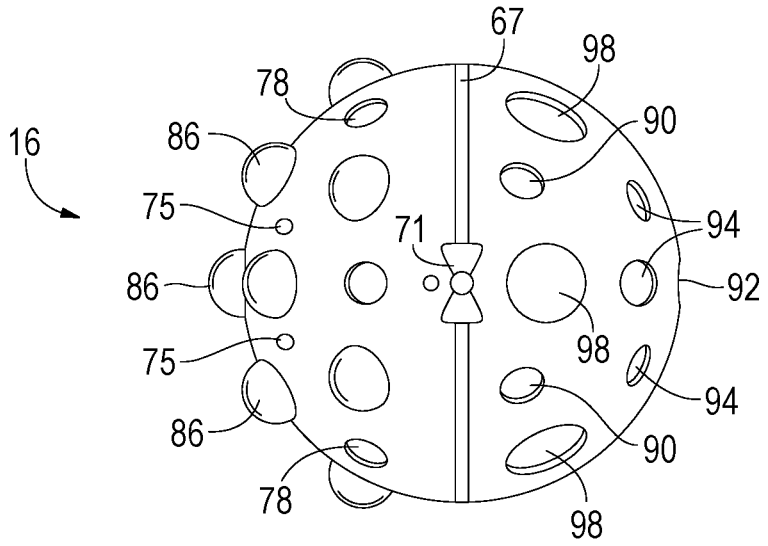
FIG. 2B shows a side view of the embodiment shown in FIG. 2A having a channel ring mounted in the channel between the outside and inside hemisphere sections.
Figure 2C:
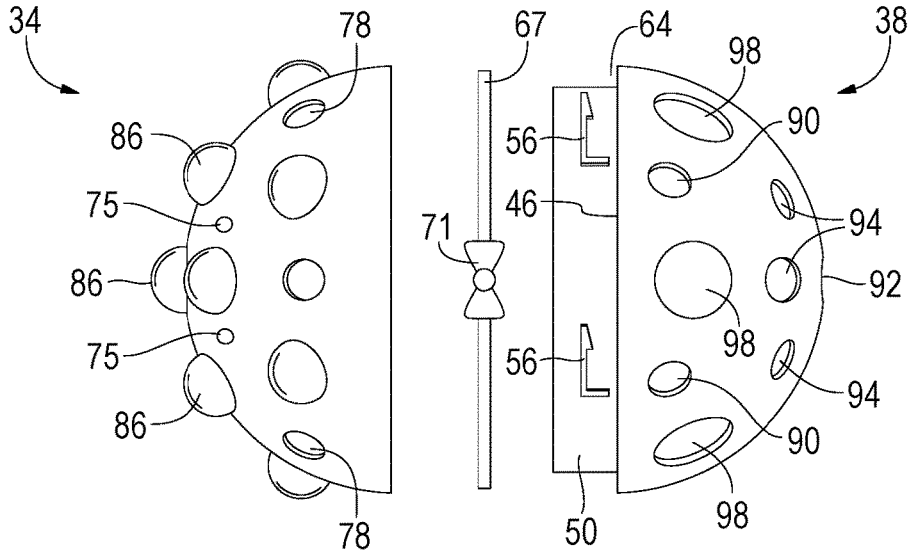
FIG. 2C shows an exploded view of the sphere of FIG. 2B showing disengaged outside and inside hemisphere sections and channel ring.
Figure 2D:
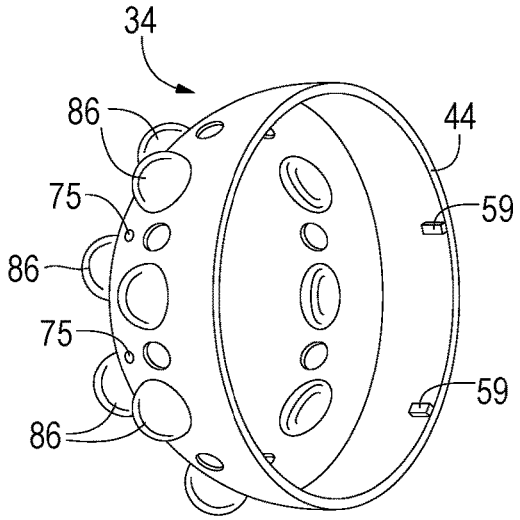
FIG. 2D shows a perspective view of an outside hemisphere portion of a preferred embodiment of an apparatus of the invention.
Figure 2E:
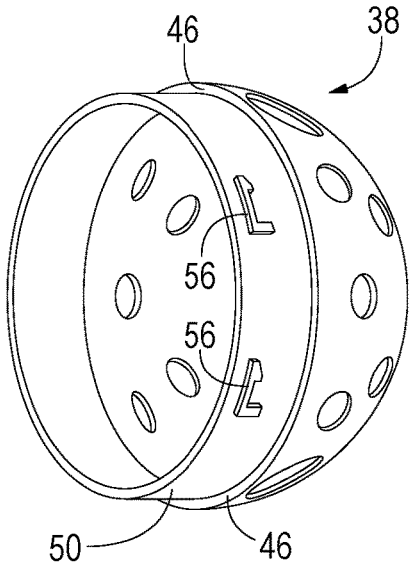
FIG. 2E shows a perspective view of an inside hemisphere portion of a preferred embodiment of an apparatus of the invention.

Inside hemisphere 38 further includes a circumferential lip 50 which depends away from flat edge 46 to facilitate reversible coupling of the outside and inside hemispheres (FIGS. 2C-2D). Reversible engagement of outside hemisphere 34 and inside hemisphere 38 can be provided by any means known to the skilled artisan. Preferably the outside and inside hemispheres are reversibly engaged by a press and twist locking mechanism whereby a plurality of recessed regions 56 on lip 50 of the inside hemisphere engage with a corresponding number of stop posts 59 on the inner surface of outside hemisphere portion 34 near flat edge 44. When coupled, the outside and inside hemispheres define a channel 64 around the central region of sphere 16 that receives a securing ring 67, preferably a silicon ring (FIGS. 2A-2B). To facilitate placement and removal of securing ring 67 from channel 64, a finger tab 71 can be included.

Apparatus 10 further includes a plurality of flexible tubes 12 that are inserted through the flexible tube holes 98 of each inside hemisphere to hold the two opposing spheres 16 in spaced relation to each other. Apparatus 10 may include from two to eight flexible tubes 12; most preferably apparatus 10 has six flexible tubes. Each flexible tube is preferably from 18 to 22 inches in length, with a diameter of 0.25 inch to 0.5 inch; preferably each tube is 16 inches in length, having a 6 millimeter (mm) inner diameter and a 10 mm outer diameter. The flexible tubes can be made from any suitable flexible material such as plastic or rubber. Preferably, the flexible tubes are fabricated from a cross-linked high-density polyethylene material such as PEX tubing. Each flexible tube has opposing ends 13 having two diametrically opposed holes 14 through which a tube end-securing strap or cord 40 is fed for cinching the tube ends 13 together inside each sphere during assembly of apparatus 10 (FIGS. 3A-3B). Securing strap 40 can be of any suitable size and material such as plastic, silicone, rubber, or fabric ranging in length from 10 inches to 15 inches; preferably securing strap 40 is an 11-inch plastic zip tie.

When assembling apparatus 10, flexible tube ends 13 are inserted into each of the inside hemispheres 38 through tube holes 98. After cinching the tube ends together and coupling the outside and inside hemispheres, flexible tubes 12 assume an arched, outwardly-bowed configuration spanning between the two opposing spheres to provide an open structure, around which a sheet or blanket can be secured to prevent wadding or entanglement during drying (FIG. 1B).

Figure 4A:
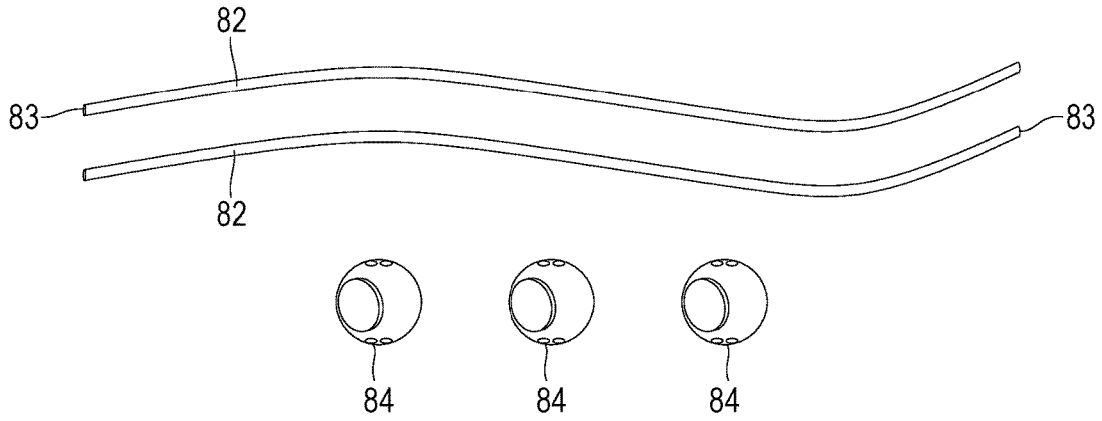
FIG. 4A provides a schematic of two sheet-holding cords and three cord holders according to a preferred embodiment of an apparatus of the invention.
Figure 4B:
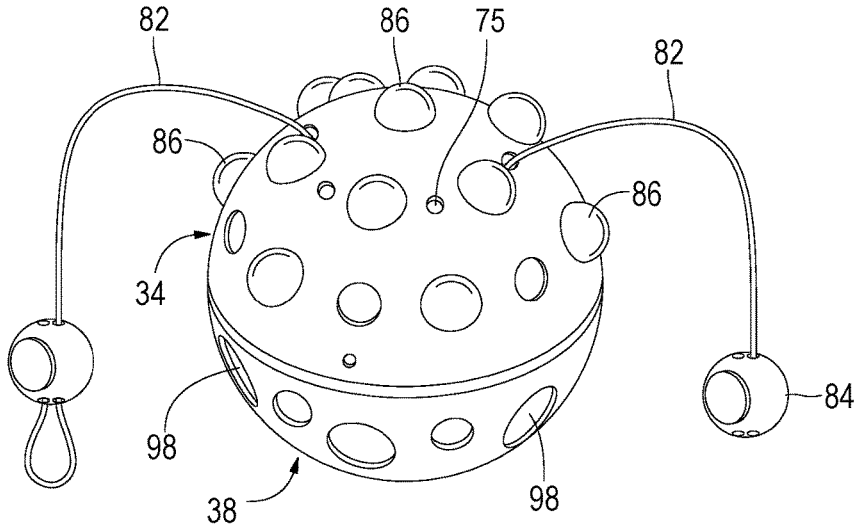
FIG. 4B shows a sheet-holding cord engaged with the outside hemisphere section of an embodiment of a sphere of the present invention.

Referring now to FIGS. 4A-4B, prior to coupling the outside and inside hemispheres, a sheet securing cord 82 is attached to each outside hemisphere 34 for securing a blanket or sheet to apparatus 10. Cord 82 is looped through two opposing small holes 75 on outside hemisphere 34 such that the free ends 83 extend on opposite sides of the outside hemisphere and can be reversibly engaged to corresponding free ends attached to the other outside hemisphere, by any suitable means known to the skilled artisan, for example, by cord fasteners 84. Referring now to FIG. 1B, the free ends 83 on one side of the apparatus are inserted into a single cord fastener while the free ends on the opposite side of the apparatus are each inserted into a cord fastener with the free end in one of the cord fasteners being circled back on itself to form a loop for slipping over the other cord fastener, thereby facilitating easy attachment or removal of a sheet from the apparatus. Cord 82 can be fabricated from any suitable material including plastic, rubber, or fabric, preferably silicone; and can be from 18 inches to 24 inches in length, preferably 20 inches. Cord fastener 84 can be any of a variety of commercially available cord stops or fasteners that can accommodate at least two cord ends, preferably fabricated from plastic.

An apparatus of the present invention can have any desired dimensions and be fabricated from any suitable material including plastic, rubber, or metal. For example, the apparatus can be from 12 to 25 inches in length, i.e. from end to end, preferably 16 inches, and from 8 to 18 inches in width, preferably 12 inches. The opposing spheres can have a diameter of from 2 to 6 inches, preferably 3 inches.

Figure 5A:
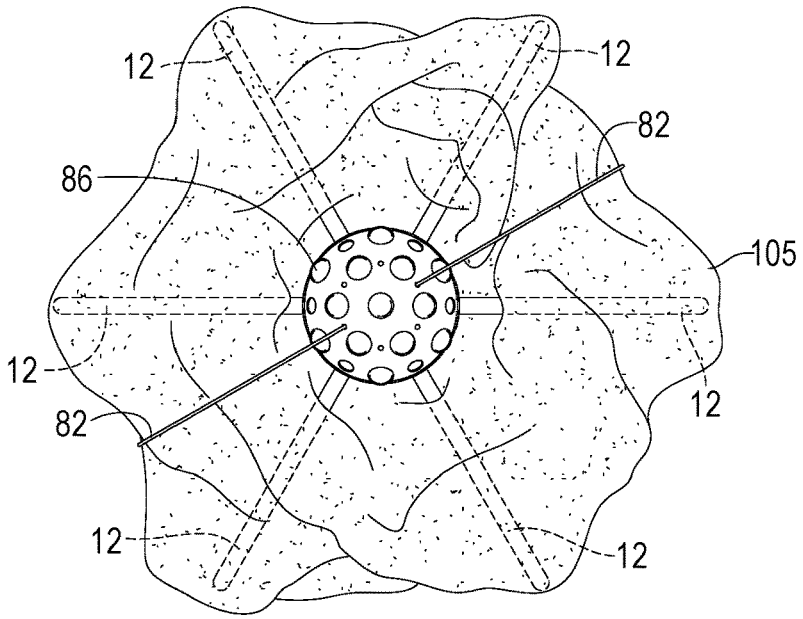
FIG. 5A provides an end perspective view of an embodiment of an apparatus of the invention having a blanket secured thereto.
Figure 5B:
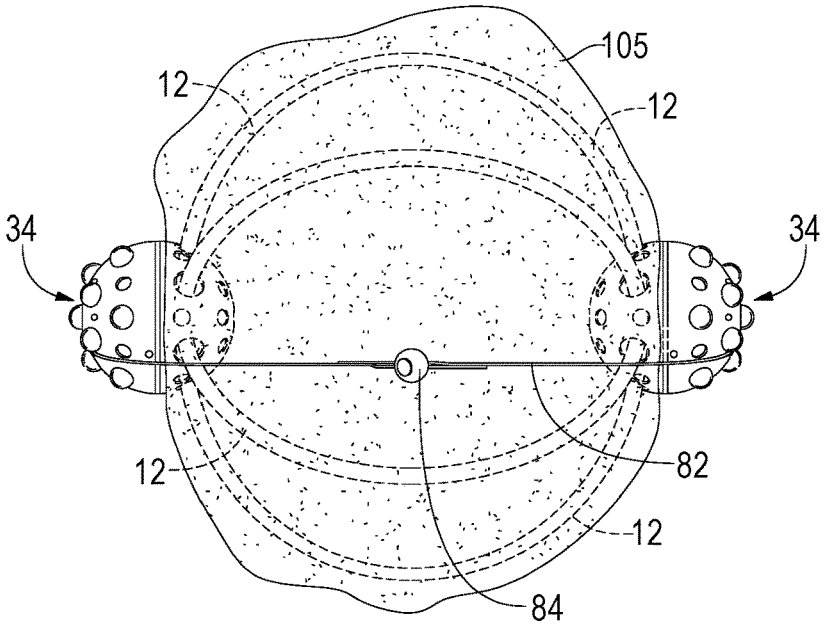
FIG. 5B shows a side view of the embodiment depicted in FIG. 5A.

In use, a wet sheet or blanket 105 is wrapped around the apparatus 10 and secured thereto with securing cords 82 prior to being placed into a clothes-drying machine (FIGS. 5A-5B). Placement of a sheet or blanket over the apparatus maintains an open pocket in the center of the sheet or blanket thereby preventing wadding to promote more efficient drying.

In another aspect, the invention relates to a method for efficiently drying one or more sheets or blankets in a clothes-drying machine. In this aspect, an apparatus of the invention is placed approximately in the center region of a sheet or blanket and secured thereto using the sheet securing cords (FIGS. 5A-5B). The apparatus can accommodate a single sheet or blanket, or two sheets or blankets by placing one on each side of the apparatus prior to securing with the cords. The securing cords 82 can be adjusted as needed using the cord fasteners 84 to provide the desired tension in the cord.

While the invention has been shown and described in some detail with reference to specific exemplary embodiments, there is no intention that the invention be limited to such detail. On the contrary, the invention is intended to include any alternative or equivalent embodiments that fall within the spirit and scope of the invention as described and claimed herein.

The invention claimed is:

1. An apparatus to prevent wet textile items from wadding during a drying cycle in a clothes-drying machine, comprising:

a) two objects each having a hollow interior space and a plurality of holes through the walls thereof; and b) a plurality of flexible tubes that interpose between the two objects to maintain them in spaced relation to each other;

c) wherein the objects have a shape selected from sphere, spheroid, ellipsoid, cube or cuboid;

d) wherein the objects comprise reversibly coupling outside and inside portions, and wherein each flexible tube has opposing ends, each end being inserted into the hollow interior space of one of the two objects;

e) wherein the objects are spheres comprising reversibly coupling outside hemisphere and inside hemisphere portions, and wherein the ends of the flexible tubes are inserted through the inside hemisphere portion and cinched together, such that the flexible tubes spanning between each sphere are bowed outwardly, thereby imparting a spherical or elliptical structure to the apparatus.

2. An apparatus as in claim 1, wherein the inside hemisphere portions of each sphere include a hole at the apex, and the apparatus further comprises two sphere securing straps having ends that pass through the hole at the apex of each inside hemisphere portion wherein the ends of each securing strap are reversibly engaged over the cinched flexible tube ends.

3. An apparatus as in claim 2, wherein each outside hemisphere portion includes a textile securing cord.

4. An apparatus as in claim 3, having from 2 to 8 flexible tubes.

5. An apparatus as in claim 4 having 6 flexible tubes.

6. An apparatus as in claim 5, wherein the flexible tubes are from 18 to 22 inches in length having a diameter of 0.25 to 0.5 inch.

7. An apparatus as in claim 6, wherein the spheres have a diameter from 2 to 6 inches.

8. An apparatus as in claim 7, wherein the spheres and/or flexible tubes are fabricated from plastic or rubber.

9. An apparatus as in claim 8, wherein the spheres and flexible tubes are fabricated from high density polyethylene.

10. An apparatus to prevent wet textile items from wadding during drying in a clothes-drying machine, comprising:

a) two spheres each comprising reversibly engaging outside and inside hemisphere portions that define a hollow interior space within each sphere, wherein the outside and inside hemisphere portions include a plurality of holes penetrating the walls thereof, the inside hemisphere portions further including a hole at the apex thereof, and the outside hemisphere portions including a plurality of knobs extending outward from the surface thereof;

b) a plurality of flexible tubes having opposing ends that are inserted through the inside hemisphere portions of the spheres into the hollow interior space thereof, wherein the tube ends are cinched proximal to each other forming a cluster, such that the region of the flexible tubes spanning between each sphere is bowed outwardly;

c) two sphere securing straps having ends that pass through the hole at the apex of each inside hemisphere into the hollow interior space, wherein the securing strap ends in each sphere are engaged over the tube end clusters; and d) a textile securing cord attached to each outside hemisphere portion.

11. An apparatus as in claim 10 wherein the outside and inside hemisphere portions are reversibly coupled by a twist-lock mechanism.

12. An apparatus as in claim 11 wherein the spheres have a diameter of from 2 to 6 inches and the flexible tubes are from 18 to 22 inches in length.

13. An apparatus as in claim 12 wherein there are from two to eight flexible tubes.

14. An apparatus as in claim 13 wherein there are six flexible tubes.

15. A method for drying a textile item in a clothes-drying machine to prevent clumping, comprising the steps of:

(1) placing a de-wadding device at the central region of the textile item wherein the de-wadding device comprises two porous hollow spheres and a plurality of flexible tubes that interpose between the spheres to maintain the spheres in spaced relation to each other;

(2) securing the textile item around the de-wadding device; and (3) placing the textile item secured to the de-wadding device of step 2 into a clothes-drying machine;

(4) wherein the textile item is secured around the de-wadding device in step 2 with a pair of textile securing cords.

16. A method as in claim 15, wherein the de-wadding device has six flexible tubes.

* * * * *